United States Patent [19]

Culpepper et al.

[11] 4,111,105

[45] Sep. 5, 1978

[54] MACHINE AND METHOD FOR PLACING AN INSERT INTO AN ARTICLE CARRIER CELL

[75] Inventors: Will Lester Culpepper, Tucker; Jack Seabron Cooley, Atlanta, both of Ga.

[73] Assignee: The Mead Corporation, Dayton, Ohio

[21] Appl. No.: 791,790

[22] Filed: Apr. 28, 1977

[51] Int. Cl.[2] ..... B31B 1/44

[52] U.S. Cl. ..... 93/37 SP; 53/175; 53/393

[58] Field of Search ..... 53/175, 393; 93/36.01, 93/37 R, 37 SP

[56] References Cited

U.S. PATENT DOCUMENTS

| | | | |
|---|---|---|---|
| 1,313,974 | 8/1919 | Anderson | 53/175 |
| 2,299,474 | 10/1942 | Evans | 53/175 |
| 3,381,452 | 5/1968 | Gentry et al. | 53/393 |
| 3,780,627 | 12/1973 | Roda | 93/37 R |

*Primary Examiner*—Joseph H. McGlynn
*Assistant Examiner*—Paul A. Bell
*Attorney, Agent, or Firm*—Walter M. Rodgers; Walter A. Rodgers

[57] ABSTRACT

A machine for placing an insert having a main panel and a bottom panel into an article carrier cell comprises a frame and a reciprocably operable insertion blade mounted thereon. The cell of the article carrier is positioned directly below the insertion blade so that the blade is operable to fold and lower the insert into the cell.

11 Claims, 8 Drawing Figures

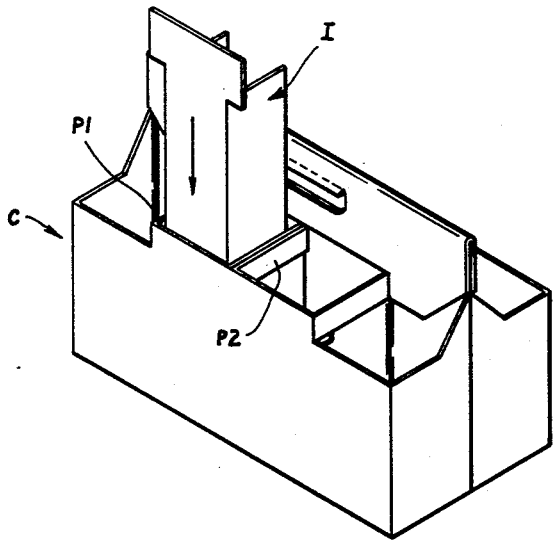
Fig. 1
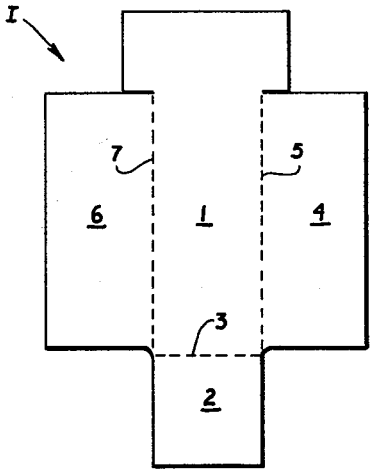
Fig. 2
Fig. 3A
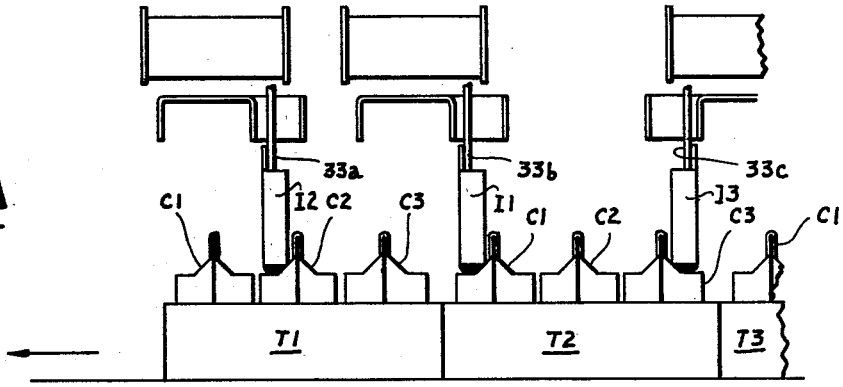
Fig. 3B
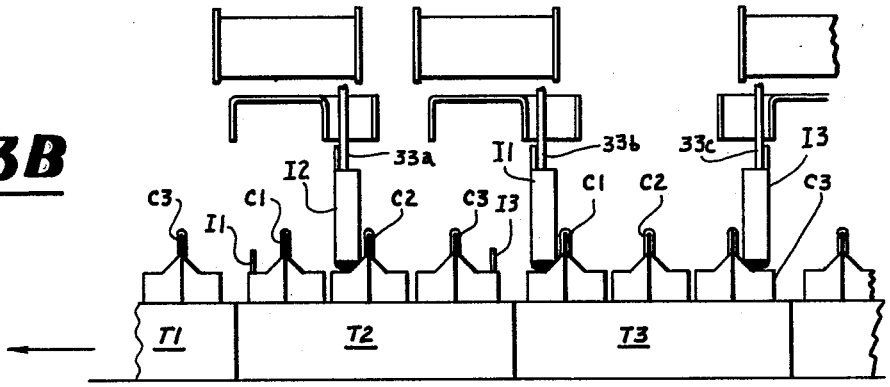

15
16
13
34
12
14
22
H
33
23a
52
20
17
21
24a
5
5
25
31
18
19
38
11
6
6
9
10
27
26
8

MACHINE AND METHOD FOR PLACING AN INSERT INTO AN ARTICLE CARRIER CELL

In general machines for placing an insert into an article carrier cell are known. One machine of this type is disclosed and claimed in U.S. Pat. No. 3,381,452 which is owned by the assignee of this invention. In this arrangment, a machine is provided by which a single panel insert is lowered into a loaded article carrier cell. Since this type of insert is not effectively anchored, the insert can become dislodged by movement of the packaged bottles during transport.

According to this invention, a machine is provided for placing an insert having a main panel joined to a bottom panel into an article carrier cell, and comprises a frame, a vertically reciprocable insertion blade mounted on the frame and engageable with the insert in general proximity to the junction between the main and bottom panels and operable in conjunction with folding elements on the frame to fold and lower the insert into the cell.

For a better understanding of the invention, reference may be had to the following detailed description taken in conjunction with the accompanying drawings in which:

FIG. 1 is a perspective view of a multiple cell article carrier with an insert partially loaded therein;

FIG. 2 is a plan view of an insert blank to which this invention is applicable;

Figure 4:
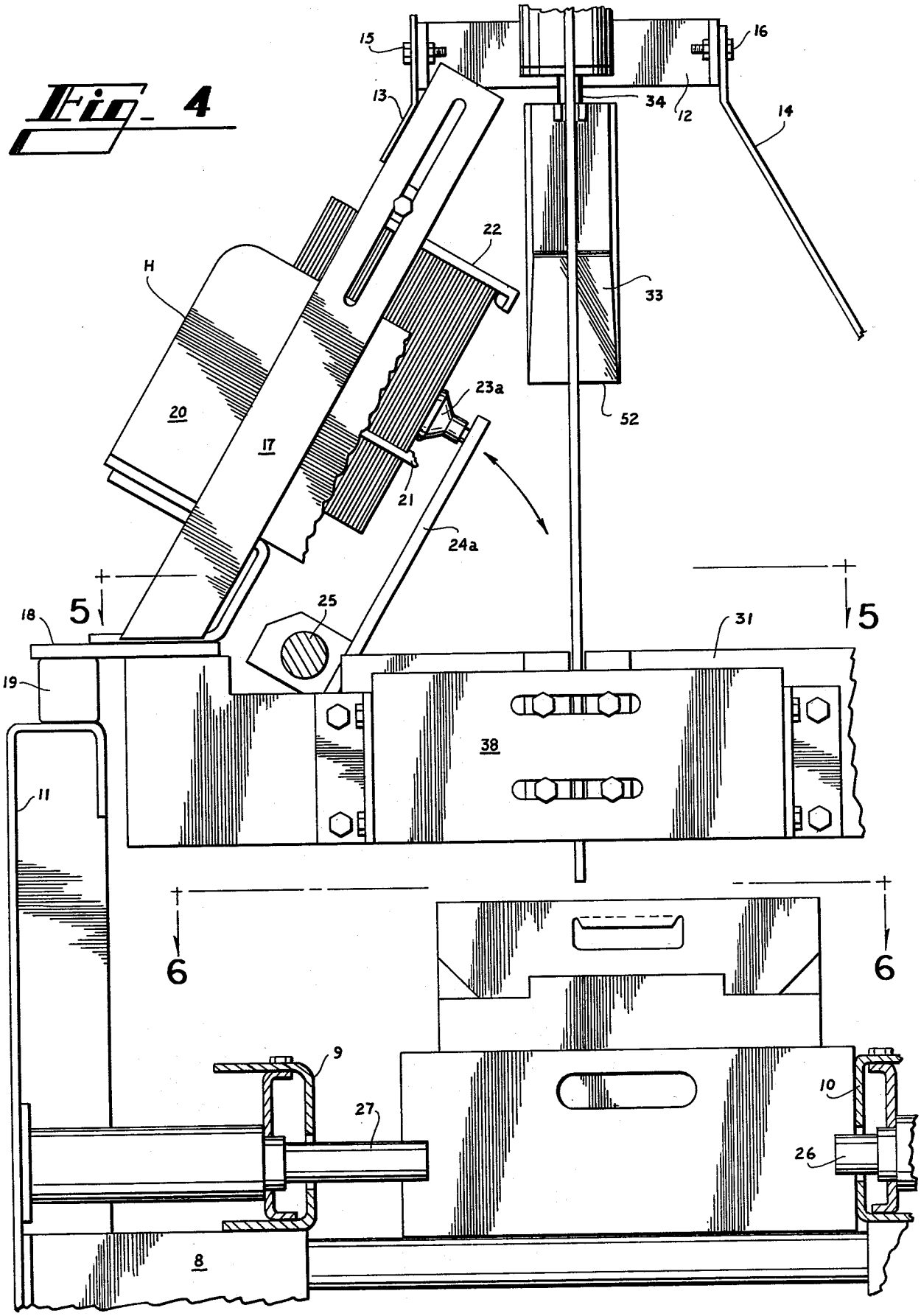
Figure 5:
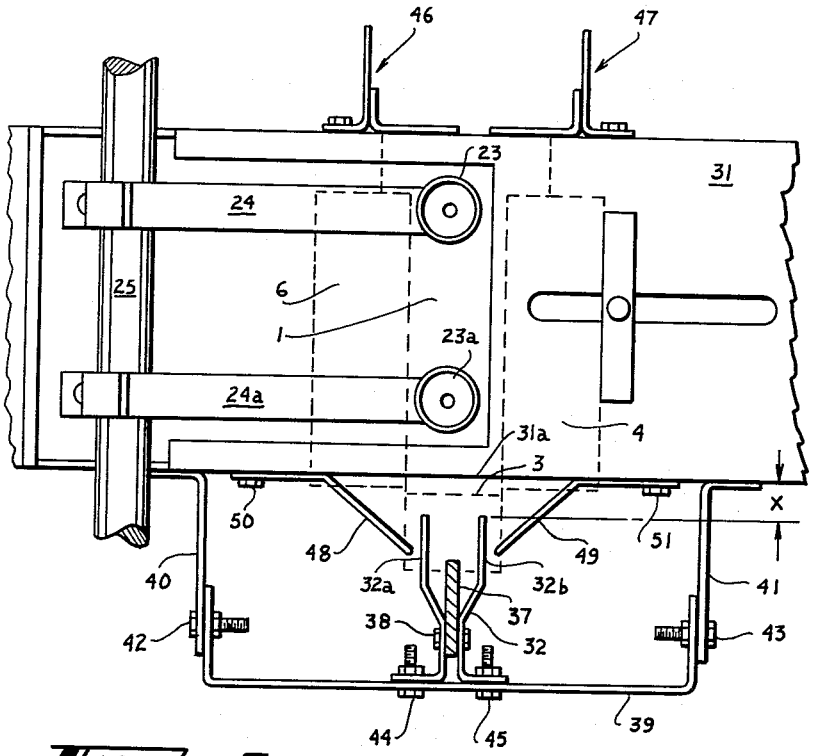
Figure 7:
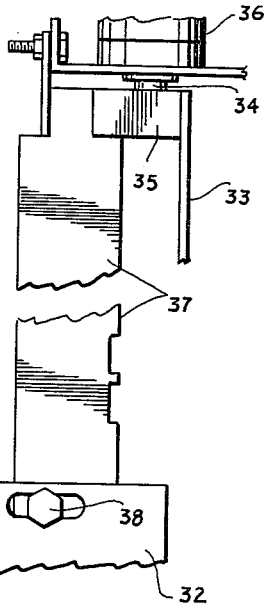
Figure 6:
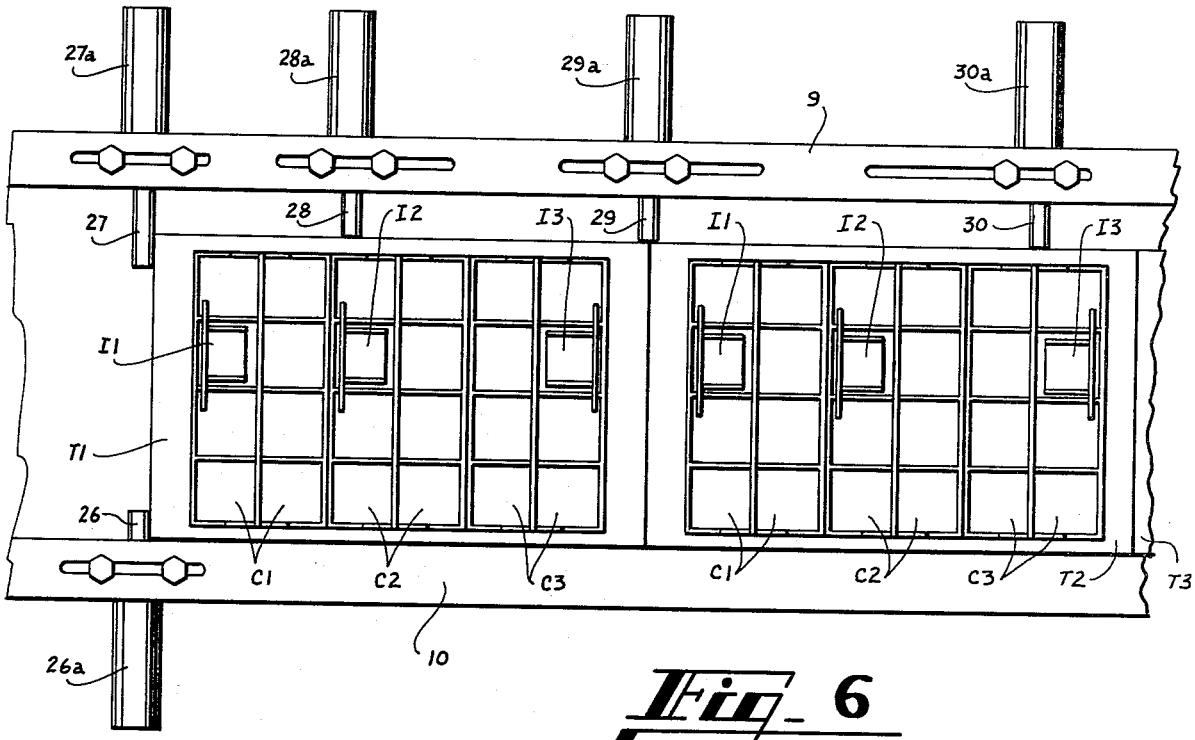

FIGS. 3A and 3B schematically depict successive stages of an insert loading operation for multiple cell article carriers arranged in series;

FIG. 4 is an enlarged end view of the machine constructed according to this invention as viewed from the outfeed end thereof;

FIG. 5 is a top plan view taken along the line designated 5—5 in FIG. 4;

FIG. 6 is a top plan view taken along the line 6—6 in FIG. 4; and in which FIG. 7 is an enlarged view of a portion of an insertion blade constructed according to this invention.

In FIG. 1, the letter C generally designates a known eight cell basket style article carrier with insert I shown as being partially loaded therein. With particular reference to FIG. 2, insert I comprises a main panel 1 to the bottom edge of which bottom panel 2 is foldably joined along fold line 3. In addition auxiliary panel 4 is foldably joined to a side edge of main panel 1 along fold line 5 and, similarly, auxiliary panel 6 is foldably joined along the opposite side edge of main panel 1 along fold line 7. If desired auxiliary panels 4 and 6 may be eliminated from insert I without destroying the effectiveness or the integrity of the insert.

With reference to FIG. 4, only the left hand portion of the machine frame structure is shown in detail, it being understood that the opposite side of the machine frame embodies the same basic structure. More particularly base element 8 is provided to the upper surface of which a longitudinal channel 9 is suitable secured by any means such as welding. Similarly, a longitudinal channel 10 is disposed in a direction laterally opposite to longitudinal channel 9. In addition side plate 11 is secured to base element 8 by any suitable means such as welding.

The frame structure for the upper portion of the machine comprises upper crosshead support means 12 to the opposite sides of which support beams 13 and 14 are secured respectively by means of nut and bolt assemblies 15 and 16. To complete the basic frame structure, the upper portion of support 17 is secured to support beam 13 while the lower edge of support 17 is secured to plate 18. Finally plate 18 is supported on side plate 11 by means of cushioning bar 19.

For the purpose of storing inserts I, hopper structure H is provided, a portion of which is shown in FIG. 4. The hopper structure H comprises a pair of oppositely disposed blank retaining walls 20 (one of which is not observable in FIG. 4) together with a lower support rod 21 and an upper adjustable support rod 22. Although not shown a second lower support rod and a second upper support rod can be provided to insure proper stability of the inserts. In order to withdraw an insert I from the hopper a pair of suction cups 23 and **23*a* are provided and are mounted on oscillatable operating arms 24 and 24*a* which in turn are mounted on rod 25** in known manner.

In actual practice, normally three article carriers C are loaded into trays T, as shown in FIG. 6, and trays T are mounted on conveyor rollers in known manner. In order to provide proper registry of a cell of the article carriers C with the insertion means prior to the placing of an insert I into one of the carrier cells, stop probes 26 and 27 are actuated pneumatically in order to initially stop carrier movement. Subsequently lateral probes 28, 29 and 30 are pneumatically actuated and act to firmly engage and to push trays T against stop means such as longitudinal channel 10. All of the probes 26, 27, 28, 29 and 30 are pneumatically operated in known manner by means of pneumatic cylinders **26*a*, 27*a*, 28*a*, 29*a* and 30*a***. By this means proper disposition of article carriers C is accomplished and destruction of the article carriers during an insert loading operation is prevented.

Therefore when the production line is stopped and the carriers C are properly positioned as shown in FIG. 6, the lowermost insert I in the hopper H is withdrawn by means of suction cups 23 and **23*a*. Subsequently the insert is placed on main platform 31 as best shown in dotted lines in FIG. 5. Simultaneously with this operation bottom panel 2 of insert I is situated on blank engaging means 32. The area between main platform 31 and blank engaging means 32** is indicated by the letter X and defines a clearance space.

For the purpose of lowering insert I into a carrier cell, insertion blade 33 is mounted on piston rod 34 and is provided with guide means 35. In addition insertion blade 33 is reciprocably operable by pneumatic means through pneumatic cylinder 36. Therefore actuation of insertion blade 33 causes guide means 35 to slide in a vertical direction along guide plate 37 which is fixedly mounted to blank engaging means 32 by means of nut and bolt assembly 38.

Blank engaging means 32 is secured to the frame by means of brackets 39, 40 and 41. Brackets 40 and 41 are respectively secured at one end thereof to the ends of bracket 39 by means of nut and bolt assemblies 42 and 43 and blank engaging means 32 is secured to plate 39 by nut and bolt assemblies 44 and 45.

Main platform 31 is welded along one edge thereof to brackets 40 and 41 and secured at the other end thereof to frame assemblies 46 and 47. In addition, as best shown in FIG. 5, plows 48 and 49 are provided and are suitably secured to main platform 31 by means of bolts 50 and 51 respectively.

With insert I disposed in the position shown by dotted lines in FIG. 5 and with the article carriers C positioned as shown in FIG. 6, insertion blade 33 is pneumatically actuated through pneumatic cylinder 36 which causes insertion blade 33 to begin its descent. Subsequently the lower edge 52 of insertion blade 33 comes into contact with insert I generally in coincidence with fold line 3. This operation causes main panel 1 and auxiliary panels 4 and 6 to slide off of main platform 31 and similarly causes bottom panel 2 to slide off of blank engaging means 32. Simultaneously bottom panel 2 and main panel 1 swing into angular relation to each other so that bottom panel 2 is disposed between blade 33 and the prongs 32*a* and 32*b* of blank engaging means 32 and with main panel 1 disposed between blade 33 and the edge 31*a* of platform 31. Simultaneously auxiliary panels 4 and 6 slidably engage plows 49 and 48 respectively which cause auxiliary panels 4 and 6 to rotate about fold lines 5 and 7 respectively through angles greater than 90° so as to envelope the upwardly folded bottom panel 2.

As insertion blade 33 reaches its lowest point of descent side panels 4 and 6 clear plows 49 and 48 and respectively swing outwardly. Bottom panel 2 then swings away from main panel 1 and into flat face contacting relation with the bottom of the associated article carrier cell due to the inherent "fight" of the material. As insertion blade 33 is withdrawn auxiliary panels 4 and 6 occupy positions generally perpendicular to main panel 1 due to the "fight" of the material causing these panels to engage carrier partitions P1 and P2. The various elements of insert I then occupy the positions generally shown in FIG. 6. Insert I at this point is fully loaded into the article carrier cell which is then ready to receive a primary package such as a bottle.

Due to the fact that bottles are of many sizes, it follows that basket style carriers such as C are of widely varying dimensions. Thus the insertion blades 33*a*, 33*b* and 33*c* are adjustable horizontally from right to left and vice versa and viewed in FIGS. 3A, 3B. In addition the insertion blades may be used in special sequences in order to render the machine adaptable for different sizes of article carriers C without unduly increasing the size of the machine. For example in FIG. 3A insertion blade 33*a* is aligned with a cell of carrier C2 in tray T1 while insertion blades 33*b* and 33*c* are aligned respectively with cells of carriers C1 and C3 in tray T2. Simultaneous downward movement of all of the insertion blades 33*a*, 33*b* and 33*c* loads insert I2 into carrier C2 of tray T1, I1, into carrier C1 of tray T2 and I3 into carrier C3 of tray T2. After this operation trays T1 and T2 and a succeeding tray T3 are moved incrementally to the left to bring a succeeding tray T3 into position as shown in FIG. 3B. Downward movement of all of the insertion blades repeats the operation previously described so as to effect insertion into carrier C2 of tray T2 and into carriers C1 and C3 of tray T3. Since carriers C1 and C3 of tray T2 have already been loaded as represented in FIG. 3A, the loading of carrier C2 in tray T2 as shown in FIG. 3B completes the placement of an insert into all carriers of tray T2. The operation then is repeated in sequence.

The procedure shown in FIGS. 3A and 3B is illustrative only, it being understood that other sequences may be employed for different sizes of bottles and for different sizes of carriers.

While the carriers in certain views of the drawings are shown as mounted in trays, it will be understood that for some applications of the invention trays may not be used particularly in instances where the carriers are unusually large.

The embodiments of the invention in which an exclusive property or privilege is claimed are defined as follows:

1. A machine for placing an insert into an article carrier cell, said insert being constructed of semirigid sheet material and comprising a main panel and a bottom panel foldably joined by a fold line to said main panel and being substantially coplanar when in blank form, said machine comprising a frame, a vertically reciprocable insertion blade mounted on said frame and engageable with said insert in general proximity to said fold line between said main panel and said bottom panel and operable in conjunction with a pair of fixed folding elements mounted in said frame to fold both said bottom panel and said main panel upwardly from said fold line and toward each other and simultaneously to lower said insert into said cell, and the lower edge of said insertion blade being approximately the same length as said fold line between said main panel and said bottom panel and being substantially coincidental therewith during folding and lowering of said insert.

2. A machine according to claim 1 wherein said folding elements comprise platform means arranged to define a clearance space.

3. A machine according to claim 1 wherein said folding elements comprise a main platform and blank engaging means and wherein the area generally intermediate said main platform and said blank engaging means defines a clearance space.

4. A machine according to claim 3 wherein said clearance space is greater than twice the thickness of said insert plus the thickness of said insertion blade.

5. A machine according to claim 1 wherein a first auxiliary panel is foldably joined to a side edge of said main panel and wherein a first plow is secured to said frame and engageable with said first auxiliary panel to cause said first auxiliary panel to swing through an angle greater than 90° during the lowering of said insert.

6. A machine according to claim 5 wherein a second auxiliary panel is foldably joined to said main panel along the side edge thereof remote from said first auxiliary panel and wherein a second plow is secured to said frame and engageable with said second auxiliary panel to cause said second auxiliary panel to swing through an angle greater than 90° during the lowering of said insert.

7. A machine according to claim 1 wherein a plurality of insertion blades are mounted on said frame and in longitudinally adjustable relation thereto.

8. A machine according to claim 1 wherein at least one laterally operable probe is provided to manipulate said carrier in a lateral direction and into engagement with a part of said frame to insure proper registry of said carrier cell with the path of movement of said blade prior to insertion of said insert into said cell.

9. A method for placing an insert having coplanar main and bottom panels foldably joined together into an article carrier cell, the method comprising the steps of placing said insert in position above said cell, initially imparting downward movement to said insert and simultaneously causing said main and bottom panels to swing upwardly and into angular relation to each other, subsequently causing said panels to swing into positions of approximately parallel relation to each other, and substantially simultaneously lowering said insert into said cell.

10. A method according to claim 9 wherein said bottom panel is moved into approximately normal angular relation to said main panel as said insert nears the limit of its downward movement.

11. A method according to claim 9 wherein a pair of auxiliary panels are foldably joined respectively to the opposite side edges of said main panel and wherein said auxiliary panels respectively are swung through angles greater than 90° simultaneously with initial swinging movement of said main and of said bottom panels.

* * * * *